US010508317B2

(12) United States Patent
Hayashi

(10) Patent No.: US 10,508,317 B2
(45) Date of Patent: Dec. 17, 2019

(54) STEEL PRODUCT AND MANUFACTURING METHOD OF THE SAME

(71) Applicant: NIPPON STEEL & SUMITOMO METAL CORPORATION, Tokyo (JP)

(72) Inventor: Koutarou Hayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 337 days.

(21) Appl. No.: 15/322,410

(22) PCT Filed: Jul. 17, 2015

(86) PCT No.: PCT/JP2015/070566

§ 371 (c)(1),
(2) Date: Dec. 27, 2016

(87) PCT Pub. No.: WO2016/010144

PCT Pub. Date: Jan. 21, 2016

(65) Prior Publication Data

US 2017/0130286 A1 May 11, 2017

(30) Foreign Application Priority Data

Jul. 18, 2014 (JP) ..... 2014-147934
Jul. 18, 2014 (JP) ..... 2014-147937

(51) Int. Cl.

| | |
|---|---|
| ***C21D 8/02*** | (2006.01) |
| ***C21D 6/00*** | (2006.01) |
| ***C22C 38/00*** | (2006.01) |
| ***C22C 38/58*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |

(52) U.S. Cl.

CPC ..... *C21D 8/0247* (2013.01); *C21D 6/00* (2013.01); *C21D 6/005* (2013.01); *C21D 6/008* (2013.01); *C21D 8/02* (2013.01); *C21D 8/0205* (2013.01); *C22C 38/00* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/12* (2013.01); *C22C 38/14* (2013.01); *C22C 38/16* (2013.01); *C22C 38/20* (2013.01); *C22C 38/22* (2013.01); *C22C 38/24* (2013.01); *C22C 38/26* (2013.01); *C22C 38/28* (2013.01); *C22C 38/38* (2013.01); *C22C 38/58* (2013.01); *C21D 2211/002* (2013.01); *C21D 2211/005* (2013.01); *C21D 2211/008* (2013.01)

(58) Field of Classification Search

CPC .... C21D 8/0247; C21D 8/0205; C21D 6/005; C21D 6/008; C21D 6/00; C21D 8/02; C21D 2211/008; C21D 2211/005; C21D 2211/002; C22C 38/12; C22C 38/28; C22C 38/38; C22C 38/26; C22C 38/001; C22C 38/002; C22C 38/005; C22C 38/02; C22C 38/06; C22C 38/08; C22C 38/24; C22C 38/14; C22C 38/16; C22C 38/20; C22C 38/22; C22C 38/58; C22C 38/00

See application file for complete search history.

(56) References Cited

U.S. PATENT DOCUMENTS

| | | | |
|---|---|---|---|
| 6,454,881 | B1 | 9/2002 | Hase et al. |
| 2009/0311125 | A1 | 12/2009 | Miyanishi et al. |
| 2011/0146852 | A1 | 6/2011 | Matsuda et al. |
| 2014/0050941 | A1 | 2/2014 | Kawasaki et al. |
| 2014/0205488 | A1 | 7/2014 | Jun et al. |
| 2014/0212684 | A1 | 7/2014 | Kawata et al. |
| 2014/0234660 | A1 | 8/2014 | Kawata et al. |

FOREIGN PATENT DOCUMENTS

| | | | |
|---|---|---|---|
| CN | 1380911 | A | 11/2002 |
| CN | 101542004 | A | 9/2009 |
| CN | 102282280 | A | 12/2011 |
| CN | 103502496 | A | 1/2014 |
| CN | 103717773 | A | 4/2014 |
| EP | 2 371 978 | A1 | 10/2011 |
| JP | 2003-138345 | A | 5/2003 |
| JP | 2004-269920 | A | 9/2004 |
| JP | 2010-90475 | A | 4/2010 |
| JP | 2012-237054 | A | 12/2012 |
| JP | 2014-25091 | A | 2/2014 |
| JP | 2014-47395 | A | 3/2014 |
| KR | 2013-0140183 | A | 12/2013 |
| KR | 2014-0052072 | A | 5/2014 |
| WO | 2013/047821 | A1 | 4/2013 |

OTHER PUBLICATIONS

Chinese Office Action dated Nov. 1, 2017, issued in corresponding Chinese Patent Application No. 201580037612.0.

(Continued)

*Primary Examiner* — Anthony J Zimmer

(74) *Attorney, Agent, or Firm* — Birch, Stewart, Kolasch & Birch, LLP

(57) ABSTRACT

A steel product has: a chemical composition represented by, in mass %, C: 0.050% to 0.35%, Si: 0.50% to 3.0%, Mn: exceeding 3.0% to 7.5% or less, P: 0.05% or less, S: 0.01% or less, sol. Al: 0.001% to 3.0%, N: 0.01% or less, V: 0% to 1.0%, Ti: 0% to 1.0%, Nb: 0% to 1.0%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi: 0% to 0.01%, and the balance: Fe and impurities; and a metal structure in which a thickness of a decarburized ferrite layer is 5 μm or less and a volume ratio of retained austenite is 10% to 40%, wherein tensile strength is 980 MPa or more.

14 Claims, No Drawings

(56) References Cited

OTHER PUBLICATIONS

Korean Office Action dated May 9, 2018, issued in corresponding Korean Patent Application No. 10-2017-7000832.
International Search Report for PCT/JP2015/070566 (PCT/ISA/210) dated Oct. 13, 2015.
Written Opinion of the International Searching Authority for PCT/JP2015/070566 (PCT/ISA/237) dated Oct. 13, 2015.
International Preliminary Report on Patentability for PCT/JP2015/070566, dated Feb. 2, 2017 (Forms PCT/IB/338/ PCT/IB/373 and PCT/ISA/237).

STEEL PRODUCT AND MANUFACTURING METHOD OF THE SAME

TECHNICAL FIELD

The present invention relates to a steel product and a manufacturing method thereof, and relates particularly to a steel product whose tensile strength is 980 MPa or more and which has excellent ductility and impact property, and a manufacturing method thereof.

BACKGROUND ART

In recent years, development of a steel product which contributes to energy conservation has been demanded in view of protecting global environment. In fields of an automobile steel product, an oil well pipe steel product, a building construction steel product and so on, a super-high-strength steel product which is light weighted and applicable to severe use environment is increasingly demanded and its scope of application is broadened. Consequently, securing not only a strength property but also safety in use environment is important in the super-high-strength steel product used in these fields. Concretely, it is important to raise a tolerance to external plastic deformation by increasing ductility of the steel product.

For example, in a case where an automobile collides with a structure, in order to alleviate its impact sufficiently by an anti-collision member of a vehicle, it is desired that tensile strength of a steel product may be 980 MPa or more and a value of a product (TS×EL) of the tensile strength (TS) and a total elongation (EL) may be 16000 Mpa·% or more. However, since ductility decreases considerably as the tensile strength rises, there has been no super-high-strength steel product which satisfies the above-described property and is capable of being industrially mass-produced. Thus, various research and development has been done to improve ductility of the super-high-strength steel product and structure control methods to materialize the research and development have been suggested (See Patent References 1 to 4).

However, by conventional techniques, it is impossible to obtain sufficient ductility and impact property while securing the tensile strength of 980 MPa or more.

CITATION LIST

Patent Reference

Patent Reference 1: Japanese Laid-open Patent Publication No. 2004-269920

Patent Reference 2: Japanese Laid-open Patent Publication No. 2010-90475

Patent Reference 3: Japanese Laid-open Patent Publication No. 2003-138345

Patent Reference 4: Japanese Laid-open Patent Publication No. 2014-25091

SUMMARY OF INVENTION

Technical Problem

An object of the present invention is to provide a steel product and a manufacturing method thereof, the steel product having excellent ductility and impact property while having tensile strength of 980 MPa or more.

Solution to Problem

The present inventors have conducted keen study to solve the above-described problem. As a result, the present inventors have reached the following finding.

When a steel material is heated to a two-phase region of ferrite and austenite, a surface is decarburized, whereby a structure (hereinafter, referred to as a "decarburized ferrite layer") made of a soft ferrite phase is formed. When decarburization becomes prominent, the decarburized ferrite layer is formed thick in a surface of a steel product.

When a thickness of the decarburized ferrite layer becomes 5 μm or more, coarse ferrite comes to be generated, resulting in that ductility and impact property may be deteriorated.

Thus, in order to manufacture a high-strength steel product, a proper heat treatment is applied to a steel material which contains particularly Si and Mn more positively than normal to thereby suppress decarburization in a surface. It has become obvious that the above enables stably obtaining a steel product having excellent ductility and impact property while having tensile strength of 980 MPa or more, such a steel product having not been able to be manufactured by a conventional technique.

The present invention is made based on the above-described finding and its basic gist is a steel product and a manufacturing method thereof described below.

(1) A Steel Product Which has:

a chemical composition represented by, in mass %,

C: 0.050% to 0.35%,

Si: 0.50% to 3.0%,

Mn: exceeding 3.0% to 7.5% or less,

P: 0.05% or less,

S: 0.01% or less, sol. Al: 0.001% to 3.0%,

N: 0.01% or less,

V: 0% to 1.0%

Ti: 0% to 1.0%

Nb: 0% to 1.0%

Cr: 0% to 1.0%

Mo: 0% to 1.0%

Cu: 0% to 1.0%,

Ni: 0% to 1.0%,

Ca: 0% to 0.01%,

Mg: 0% to 0.01%,

REM: 0% to 0.01%,

Zr: 0% to 0.01%,

B: 0% to 0.01%,

Bi: 0% to 0.01%, and the balance: Fe and impurities; and a metal structure in which a thickness of a decarburized ferrite layer is 5 μm or less and a volume ratio of retained austenite is 10% to 40%, wherein tensile strength is 980 MPa or more.

(2) The Steel Product According to the above (1), wherein, in the metal structure, a number density of cementite is less than 2/ $\mu m^2$.

(3) The Steel Product According to the above (1) or (2), wherein, in the chemical composition, V: 0.05% to 1.0% is satisfied.

(4) The Steel Product According to any one of the above (1) to (3), wherein, in the chemical composition, Ti: 0.003% to 1.0%, Nb: 0.003% to 1.0%, Cr: 0.01% to 1.0%, Mo: 0.01% to 1.0%,
Cu: 0.01% to 1.0%, or
Ni: 0.01% to 1.0%,
or arbitrary combination of the above is satisfied.

(5) The Steel Product According to any one of the above (1) to (4),
wherein, in the chemical composition,
Ca: 0.0003% to 0.01%,
Mg: 0.0003% to 0.01%,
REM: 0.0003% to 0.01%,
Zr: 0.0003% to 0.01%,
B: 0.0003% to 0.01%, or
Bi: 0.0003% to 0.01%,
or arbitrary combination of the above is satisfied.

(6) The Steel Product According to any one of the above (1) to (5),
wherein an average C concentration in the retained austenite is 0.6% or less in mass %.

(7) A Manufacturing Method of a Steel Product Which has the Steps of:
heating a steel material to a temperature of 670° C. or more in a manner that an average heating speed between 500° C. to 670° C. is 1° C./s to 5° C./s, which steel material has a chemical composition represented by, in mass %,
C: 0.050% to 0.35%,
Si: 0.50% to 3.0%,
Mn: exceeding 3.0% to 7.5% or less,
P: 0.05% or less,
S: 0.01% or less,
sol. Al: 0.001% to 3.0%,
N: 0.01% or less,
V: 0% to 1.0%,
Ti: 0% to 1.0%,
Nb: 0% to 1.0%,
Cr: 0% to 1.0%,
Mo: 0% to 1.0%,
Cu: 0% to 1.0%,
Ni: 0% to 1.0%,
Ca: 0% to 0.01%,
Mg: 0% to 0.01%,
REM: 0% to 0.01%,
Zr: 0% to 0.01%,
B: 0% to 0.01%,
Bi: 0% to 0.01%, and
the balance: Fe and impurities, and has a metal structure in which volume ratios of bainite and martensite are 90% or more in total and an average value of aspect ratios of bainite and martensite is 1.5 or more;
holding the temperature in a temperature range of 670° C. to 780° C. for 60 s to 1200 s after the heating; and
performing cooling to a temperature of 150° C. or less in a manner that an average cooling speed between the temperature range and 150° C. is 5° C./s to 500° C./s, after the holding.

(8) The manufacturing method of the steel product according to the above (7),
wherein, in the chemical composition,
V: 0.05% to 1.0%
is satisfied, and
wherein 70% or more of V contained in the steel material is solid-solved.

Advantageous Effects of Invention

According to the present invention, since a chemical composition and a metal composition are appropriate, it is possible to obtain tensile strength of 980 MPa or more and excellent ductility and impact property.

DESCRIPTION OF EMBODIMENTS

1. Chemical Composition

First, a chemical composition of a steel product according to an embodiment of the present invention and a steel material used for its manufacturing will be described. In the following description, "%" being a unit of a content of each element contained in the steel product and a steel sheet used for its manufacturing means "mass %" unless otherwise specified. The steel product according to the present embodiment and the steel material used for its manufacturing has a chemical composition represented by C: 0.050% to 0.35%, Si: 0.50% to 3.0%, Mn: exceeding 3.0% to 7.5% or less, P: 0.05% or less, S: 0.01% or less, sol. Al: 0.001% to 3.0%, N: 0.01% or less, V: 0% to 1.0%, Ti: 0% to 1.0%, Nb: 0% to 1.0%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi: 0% to 0.01%, and the balance: Fe and impurities. As impurities, there are exemplified what is contained in raw materials such as ore and scrap iron, and what is contained in a manufacturing process.

C: 0.050% to 0.35%

C is an element which contributes to strength increase and ductility improvement. In order to obtain a steel product which has tensile strength of 980 MPa or more and, further, in which a value of a product (TS×EL) of tensile strength (TS) and total elongation (EL) is 16000 MPa·% or more, a C content is required to be 0.050% or more. However, containing C exceeding 0.35% deteriorates an impact property. Therefore, the C content is required to be 0.35% or less and is preferable to be 0.25% or less. Note that in order to obtain tensile strength of 1000 MPa or more, the C content is preferable to be 0.080% or more.

Si: 0.50% to 3.0%

Si is an element which contributes to strength increase and ductility improvement by enhancing generation of austenite. In order to make the value of the product (TS×EL) 16000 MPa·% or more, an Si content is required to be 0.50% or more. However, containing Si exceeding 3.0% deteriorates the impact property. Therefore, the Si content is set to be 3.0% or less. Note that in order to improve weldability, the Si content is preferable to be 1.0% or more.

Mn: Exceeding 3.0% to 7.5% or Less

Mn, similarly to Si, is an element which contributes to strength increase and ductility improvement by enhancing generation of austenite. In order to make the tensile strength of the steel product 980 MPa or more and to make the value of the product (TS×EL) 16000 MPa·% or more, Mn is required to be contained exceeding 3.0%. However, containing Mn exceeding 7.5% makes refining and casting in a steel converter considerably difficult. Therefore, an Mn content is required to be 7.5% or less and is preferable to be 6.5% or less. Note that in order to obtain tensile strength of 1000 MPa or more, the Mn content is preferable to be 4.0% or more.

P: 0.05% or Less

Though P is an element contained as an impurity, since being also the element which contributes to strength increase, P may be positively contained. However, containing P exceeding 0.05% considerably deteriorates weldability. Thus, a P content is set to be 0.05% or less. The P content is preferable to be 0.02% or less. When the above-described effect is desired, the P content is preferable to be 0.005% or more.

S: 0.01% or Less

Since S is contained inevitably as an impurity, an S content is better as low as possible. In particular, the S content exceeding 0.01% brings about considerable deterioration of weldability. Thus, the S content is set to be 0.01% or less. The S content is preferable to be 0.005% or less, and is more preferable to be 0.0015% or less.

sol. Al: 0.001% to 3.0%

Al is an element which has an action to deoxidize steel. In order to achieve soundness of a steel product, sol. Al is contained 0.001% or more. Meanwhile, if a sol. Al content exceeding 3.0%, casting becomes considerably difficult. Thus, the sol. Al content is set to be 3.0% or less. The sol. Al content is preferable to be 0.010% or more and is preferable to be 1.2% or less. Note that the sol. Al content means a content of acid-soluble Al in the steel product.

N: 0.01% or Less

Since N is contained inevitably as the impurity, an N content is better as low as possible. In particular, the N content exceeding 0.01% brings about considerable deterioration of an anti-aging property. Thus, the N content is set to be 0.01% or less. The N content is preferable to be 0.006% or less, and is more preferable to be 0.004% or less.

V, Ti, Nb, Cr, Mo, Ni, Ca, Mg, REM, Zr, and Bi are not essential elements but arbitrary elements which may be contained appropriately to the extent of a predetermined amount in a steel material used for the steel product according to the present embodiment and for manufacturing thereof.

V: 0% to 1.0%

V is an element which considerably increases yield strength of a steel product and prevents decarburization. Therefore, V may be contained. However, containing V exceeding 1.0% makes hot working considerably difficult. Therefore, a V content is set to be 1.0% or less. Further, in order to make the yield strength of the steel product 900 MPa or more, it is preferable that V is contained 0.05% or more. Note that if tensile strength of 1100 MPa or more is desired, the V content is further preferable to be 0.15% or more. Further, if V is contained in a steel material, it becomes easy to adjust an average value of aspect ratios of bainite and martensite to be 1.5 or more in the steel material.

Ti: 0% to 1.0%

Nb: 0% to 1.0%

Cr: 0% to 1.0%

Mo: 0% to 1.0%

Cu: 0% to 1.0%

Ni: 0% to 1.0%

These elements are elements effective for stably securing strength of a steel product. Therefore, one kind or more selected from the above-described elements may be contained. However, regarding every element, being contained exceeding 1.0% makes hot working difficult. Thus, a content of each element is required to be 1% or less respectively. When the above-described effect is desired, it is preferable to satisfy Ti: 0.003% or more, Nb: 0.003% or more, Cr: 0.01% or more, Mo: 0.01% or more, Cu: 0.01% or more, or Ni: 0.01% or more, or arbitrary combination of the above. Note that when two kinds or more of the above-described elements are contained complexly, the total content thereof is preferable to be 3% or less.

Ca: 0% to 0.01%

Mg: 0% to 0.01%

REM: 0% to 0.01%

Zr: 0% to 0.01%

B: 0% to 0.01%

Bi: 0% to 0.01%

These elements are elements which have an action to increase low temperature toughness. Therefore, one kind or more selected from the above-described elements may be contained. However, regarding every element, being contained exceeding 0.01% deteriorates a surface property. Thus, the content of each element is required to be 0.01% or less respectively. When the above-described effect is desired, the content of one kind or more selected from these elements is preferable to be 0.0003% or more. Note that when two kinds or more of the above-described elements are contained complexly, the total content thereof is preferable to be 0.05% or less. Here, REM indicates a total of 17 elements of Sc, Y, and lanthanoid, and the above-described content of REM means the total content of these elements. Lanthanoid is added in a form of misch metal industrially.

2. Metal Structure

Thickness of decarburized ferrite layer: 5 μm or less

As described above, a decarburized ferrite layer is a structure made of a soft ferrite phase which is formed as a result that a surface of a steel product is decarburized during a heat treatment. Further, the decarburized ferrite layer is a structure which includes a ferrite phase exhibiting a columnar shape or a multangular shape 90% or more in terms of area ratio. In order to maintain an excellent impact property while having tensile strength as high as 980 MPa or more and to, it is necessary to suppress decarburization in a surface layer portion. When a thickness of the decarburized ferrite layer exceeds 5 μm, not only a fatigue property of the steel product but also an impact property is reduced, and thus the thickness of the decarburized ferrite layer is set to be 5 μm or less.

Volume Ratio of Retained Austenite: 10% to 40%

In the steel product according to the embodiment of the present invention, in order to considerably improve ductility of the steel product while the steel product has the tensile strength of 980 MPa or more, a volume ratio of retained austenite is required to be 10% or more. Meanwhile, the volume ratio of the retained austenite exceeding 40% brings about deterioration of anti-delayed fracture property. Thus, the volume ratio of the retained austenite is set to be 40% or less.

Number density of cementite: less than $2/\mu m^2$

In the steel product according to the embodiment of the present invention, in order to considerably improve the impact property, it is preferable to set a number density of cementite to be less than $2/\mu m^2$. Note that the number density of cementite is better as low as possible, thus a lower limit is not set in particular.

Average C Concentration in Retained Austenite: 0.60% or Less

Further, setting an average C concentration in retained austenite to be 0.60% or less in terms of mass % makes martensite generated with a TRIP phenomenon soft, to thereby suppress generation of a microcrack, resulting in considerable improvement of the impact property of the steel property. Thus, it is preferable to set the average C concentration in the retained austenite to be 0.60% or less in terms of mass %. The average C concentration of the retained austenite is more preferable as low as possible, so that a lower limit is not set in particular.

3. Mechanical Property

The steel product according to the embodiment of the present invention has tensile strength of 980 MPa or more. The tensile strength of the steel product is preferable to be 1000 MPa or more. Further, according to the steel product according to the embodiment of the present invention, excellent ductility and impact property can be obtained. For example, it is possible to obtain ductility of 16000 MPa·% or more in terms of value of a product of tensile strength and total elongation. For example, it is possible to obtain the impact property of 30 J/cm$^2$ or more in terms of impact value of a Charpy test at 0° C. Further, when V is contained in the steel product, it is possible to obtain, for example, 0.2% proof stress (yield strength) in which yield strength is 900 MPa or more.

4. Manufacturing Method

A manufacturing method of the steel product according to the present invention is not limited in particular, and the steel product can be manufactured, for example, by applying a heat treatment described below to a steel material having the above-described chemical composition.

4-1 Steel Material

As a steel material to be subjected to the heat treatment, there is used one having a metal structure in which, for example, volume ratios of bainite and martensite are 90% or more in total and an average value of aspect ratios of bainite and martensite is 1.5 or more. Further, the volume ratios of bainite and martensite are preferable to be 95% or more in total. Further, when the V content of the steel material is 0.05% to 1.0%, 70% or more of V contained in the steel material is preferable to be solid-solved.

If the volume ratios of bainite and martensite in the steel material are less than 90% in total, it becomes difficult to make the tensile strength of the steel product 980 MPa or more. Further, a volume ratio of retained austenite becomes low, resulting in that ductility may be deteriorated. Further, when the aspect ratios of bainite and martensite become large, cementite precipitates in parallel to a steel sheet surface, to thereby shield decarburization. When an average value of the aspect ratios of bainite and martensite is less than 1.5, shielding of decarburization is insufficient, so that a decarburized ferrite layer is generated. Further, when the average value of the aspect ratios of bainite and martensite is less than 1.5, nucleation of cementite is promoted and cementite is finely dispersed, bringing about a high number density. Note that the aspect ratio is a value obtained as a result of dividing a major axis by a minor axis of each grain of bainite and martensite when observed from a cross-section (hereinafter, L cross-section) perpendicular to a rolling direction in relation to prior austenite grain. Further, adopted is an average value of the aspect ratios obtained for all the grains in the observed surface.

Further, when solid-solved V among V contained in the steel is less than 70%, desired yield strength cannot be obtained after the heat treatment. Further, since austenite growth during the heat treatment is delayed, the volume ratio of retained austenite may become low. Therefore, it is preferable that 70% or more V among V contained in a steel material is solid-solved. A solid solution amount of V can be measured by analyzing residue by using an ICP-OES (Inductively Coupled Plasma Optical Emission Spectrometry) after the steel material is subjected to electroextraction, for example.

The above-described steel material can be manufactured, for example, by hot rolling at a comparatively low temperature. Concretely; hot rolling is carried out so that a finishing temperature may be 800° C. or less and a reduction ratio of a final pass may be 10% or more, and within 3 s after the end of finish rolling, rapid cooling to a temperature of 600° C. or less is carried out at an average cooling speed of 20° C./s or more. Hot rolling at a comparative low temperature as above is normally avoided since a non-recrystallized grain is generated. Further, when the steel material contains V 0.05% or more, hot rolling is carried out so that the finishing temperature may be 950° C. or less and the reduction ratio of the final pass may be 10% or more, and rapid cooling to the temperature of 600° C. or less is carried out at the average cooling speed of 20° C./s or more within 3 s after the end of finish rolling. When V is contained in particular, the average value of the aspect ratios of bainite and martensite is easy to become 1.5 or more. Further, in a case of a steel structure in which an average value of aspect ratios of bainite and martensite is 1.5 or more, a steel material thereof may be tempered.

4-2 Heat Treatment

As described above, the steel product according to the present invention can be manufactured by applying following processings to the above-described steel materials. Each step will be described in detail below.

a) Heating Step

First, the above-described steel material is heated to a temperature of 670° C. or more in a manner that the average heating speed between 500° C. and 670° C. becomes 1° C./s to 5° C./s. Though cementite has an action to suppress decarburization during the heat treatment, coarse cementite, if remaining in the steel product, deteriorates an impact property considerably. Therefore, a grain diameter of cementite and temperature control between 500° C. to 670° C. where a precipitation reaction is easy to be controlled are quite important.

The average heating speed less than 1° C./s brings about coarse cementite to thereby suppress decarburization. However, coarse cementite remains in the steel product after the heat treatment to thereby deteriorate the impact property. Further, generation of austenite becomes insufficient, which may deteriorate ductility. Meanwhile, the average heating speed exceeding 5° C./s brings about easy melting of cementite during the heat treatment, resulting in that a decarburization reaction during the heat treatment cannot be suppressed.

Note that in heating to 500° C., the average heating speed is preferable to be set at 0.2° C./s to 500° C./s. The average heating speed less than 0.2° C./s decreases productivity. On the other hand, the average heating speed exceeding 500° C./s may bring about difficulty in temperature control between 500° C. to 670° C. due to overshoot or the like.

b) Holding Step

After the above-described heating, the temperature is held in a temperature range of 670° C. to 780° C. for 60 s to 1200 s. A holding temperature of less than 670° C. not only leads to deterioration of ductility but also may bring about difficulty in making the tensile strength of the steel product 980 MPa or more. On the other hand, when the holding temperature exceeds 780° C., it is not possible to make the volume ratio of retained austenite of the steel product 10% or more, resulting in that deterioration of ductility may become prominent.

Further, when a holding time is less than 60 s, a generated structure and tensile strength are not stable, and thus securing the tensile strength of 980 MPa or more may become difficult. On the other hand, when the holding time exceeds 1200 s, internal oxidation becomes prominent, resulting in that not only the impact property is deteriorated but also a decarburized ferrite layer becomes easy to be generated. The holding time is preferable to be 120 s or more and is preferable to be 900 s or less.

c) Cooling Step

After the aforementioned heating holding, cooling is carried out to a temperature of 150° C. or less in a manner that an average cooling speed between the above-described temperature range and 150° C. becomes 5° C./s to 500° C./s. An average cooling speed of less than 5° C./s brings about excessive generation of soft ferrite and pearlite, which may result in difficulty in making the tensile strength of the steel product 980 MPa or more. On the other hand, the average cooling speed exceeding 500° C./s leads to easy generation of a quenching crack.

The average cooling speed is preferable to be 8° C./s or more, and is preferable to be 100° C./s or less. When the average cooling speed to 150° C. is set to be 5° C./s to 500°/s, the cooling speed at 150° C. or less may be the same or different as/from the above-described range.

Further, in the temperature range of 350° C. to 150° C. during cooling, C becomes easy to be unevenly distributed in austenite. Therefore, in order to make an average C concentration in retained austenite of a steel product 0.60% or less, cooling is preferable to be carried out in a manner that a residence time in the above-described temperature range is 40 s or less.

Hereinafter, the present invention will be described in more detail by way of examples, but the present invention is not limited to these examples.

EXAMPLES

Steel materials which have chemical compositions shown in Table 1 and metal structures shown in Table 2 were subjected to heat treatments under conditions shown in Table 3.

TABLE 1

| STEEL | CHEMICAL COMPOSITION (MASS %, REMAINDER: Fe AND IMPURITIES) | | | | | | | |
|---|---|---|---|---|---|---|---|---|
| KIND | C | Si | Mn | P | S | sol. Al | N | OTHERS |
| A | 0.23 | 1.68 | 3.31 | 0.012 | 0.0013 | 0.035 | 0.0042 | |
| B | 0.074 | 1.76 | 5.25 | 0.012 | 0.0013 | 0.029 | 0.0043 | Ca: 0.0013 |
| C | 0.14 | 1.73 | 4.21 | 0.010 | 0.0011 | 0.034 | 0.0035 | REM: 0.0021 |
| D | 0.095 | 1.87 | 3.64 | 0.012 | 0.0014 | 0.035 | 0.0042 | Ni: 0.87 |
| E | 0.092 | 2.05 | 4.95 | 0.012 | 0.0013 | 0.028 | 0.0041 | Mg: 0.0014, Bi: 0.0016 |
| F | 0.10 | 3.25 * | 6.31 | 0.012 | 0.0013 | 0.028 | 0.0042 | |
| G | 0.098 | 1.43 | 4.26 | 0.009 | 0.0012 | 0.028 | 0.0046 | Cu: 0.32, Ni: 0.45, Zr: 0.0012 |
| H | 0.52 * | 1.26 | 3.13 | 0.011 | 0.0011 | 0.028 | 0.0045 | |
| I | 0.15 | 1.89 | 4.64 | 0.012 | 0.0014 | 0.031 | 0.0045 | Ti: 0.015, Nb: 0.022, Cr: 0.43 |
| J | 0.10 | 1.98 | 4.97 | 0.010 | 0.0011 | 0.028 | 0.0041 | |
| K | 0.23 | 1.43 | 1.02 * | 0.012 | 0.0012 | 0.037 | 0.0041 | |
| L | 0.11 | 1.52 | 4.42 | 0.011 | 0.0009 | 0.230 | 0.0042 | Mo: 0.12 |
| M | 0.12 | 0.75 | 4.63 | 0.013 | 0.0012 | 0.032 | 0.0042 | |
| N | 0.15 | 1.93 | 4.89 | 0.009 | 0.0009 | 0.028 | 0.0039 | Ca: 0.001, Mo: 0.15, V: 0.47 |
| O | 0.12 | 1.93 | 4.11 | 0.010 | 0.0009 | 0.034 | 0.0043 | Mg: 0.001, Cr: 0.72, V: 0.37 |
| P | 0.030 * | 1.91 | 5.05 | 0.011 | 0.0010 | 0.026 | 0.0043 | V: 0.16 |
| Q | 0.10 | 1.92 | 4.91 | 0.011 | 0.0012 | 0.028 | 0.0032 | V: 0.30 |
| R | 0.10 | 2.03 | 2.53 * | 0.012 | 0.0012 | 0.029 | 0.0045 | V: 0.16 |
| S | 0.16 | 1.52 | 4.78 | 0.005 | 0.0012 | 0.024 | 0.0041 | Ti: 0.05, Bi: 0.002, V: 0.25 |
| T | 0.20 | 1.94 | 4.88 | 0.012 | 0.0011 | 0.032 | 0.0042 | V: 0.60 |
| U | 0.072 | 0.30 * | 4.92 | 0.010 | 0.0011 | 0.027 | 0.0037 | V: 0.10 |
| V | 0.10 | 1.97 | 4.89 | 0.013 | 0.0013 | 0.032 | 0.0043 | V: 0.07 |
| W | 0.10 | 1.94 | 5.01 | 0.011 | 0.0014 | 0.028 | 0.0046 | V: 0.03 |
| X | 0.10 | 1.95 | 4.97 | 0.013 | 0.0011 | 0.026 | 0.0045 | Zr: 0.002, B: 0.001, V: 0.30 |
| Y | 0.30 | 1.87 | 5.02 | 0.013 | 0.0011 | 0.024 | 0.0048 | REM: 0.002, V: 0.85 |
| Z | 0.10 | 0.80 | 4.93 | 0.012 | 0.0010 | 0.314 | 0.0049 | B: 0.001, V: 0.20 |
| AA | 0.084 | 2.42 | 6.63 | 0.012 | 0.0013 | 0.041 | 0.0035 | V: 0.10 |
| BB | 0.11 | 1.98 | 3.20 | 0.013 | 0.0009 | 0.041 | 0.0047 | Ni: 0.9, Cu: 0.6, V: 0.20 |
| CC | 0.16 | 1.54 | 4.78 | 0.012 | 0.0011 | 0.034 | 0.0038 | Nb: 0.03, V: 0.25 |
| DD | 0.25 | 1.93 | 4.85 | 0.009 | 0.0011 | 0.028 | 0.0036 | V: 0.16 |

* MEANING THAT IT IS OUT OF A RANGE PRESCRIBED BY THE PRESENT INVENTION.

TABLE 2

| | | HOT ROLLING PROCESS | | | STEEL MATERIAL | |
|---|---|---|---|---|---|---|
| TEST NUMBER | STEEL KIND | FINISHING TEMPERATURE (° C.) | CUMULATIVE ROLLING RATIO (%) | COOLING CONDITION AFTER ROLLING | MARTENSITE VOLUME RATIO (%) | BAINITE VOLUME RATIO (%) |
| 1 | A | 780 | 15 | AFTER 2 s, TO A ROOM TEMPERATURE AT 40° C./s | 100 | 0 |
| 2 | A | 840 | 15 | AFTER 1 s, TO A ROOM TEMPERATURE AT 40° C./s | 100 | 0 |
| 3 | A | 790 | 15 | AFTER 2 s, TO A ROOM TEMPERATURE AT 40° C./s | 100 | 0 |
| 4 | A | 790 | 15 | AFTER 2 s, TO A ROOM TEMPERATURE AT 5° C./s | 45 | 50 |
| 5 | B | 780 | 15 | AFTER 1 s, TO A ROOM TEMPERATURE AT 40° C./s | 100 | 0 |
| 6 | C | 780 | 15 | AFTER 2 s, TO A ROOM TEMPERATURE AT 40° C./s | 100 | 0 |

TABLE 2-continued

| | | | | | | |
|---|---|---|---|---|---|---|
| 7 | D | 780 | 15 | AFTER 1 s, TO A ROOM TEMPERATURE AT 40° C./s | 100 | 0 |
| 8 | D | 780 | 15 | AFTER 1 s, TO A ROOM TEMPERATURE AT 40° C./s | 100 | 0 |
| 9 | D | 750 | 15 | AFTER 15 s, TO A ROOM TEMPERATURE AT 40° C./s | 95 | 0 |
| 10 | E | 780 | 15 | AFTER 1 s, TO A ROOM TEMPERATURE AT 40° C./s | 100 | 0 |
| 11 | F * | 780 | 15 | AFTER 2 s, TO A ROOM TEMPERATURE AT 40° C./s | 100 | 0 |
| 12 | G | 780 | 15 | AFTER 1 s, TO A ROOM TEMPERATURE AT 40° C./s | 100 | 0 |
| 13 | G | 780 | 15 | AFTER 1 s, TO A ROOM TEMPERATURE AT 40° C./s | 100 | 0 |
| 14 | H * | 780 | 15 | AFTER 1 s, TO A ROOM TEMPERATURE AT 40° C./s | 100 | 0 |
| 15 | I | 780 | 15 | AFTER 1 s, TO A ROOM TEMPERATURE AT 40° C./s | 100 | 0 |
| 16 | J | 780 | 15 | AFTER 1 s, TO A ROOM TEMPERATURE AT 40° C./s | 100 | 0 |
| 17 | J | 780 | 15 | AFTER 2 s, TO A ROOM TEMPERATURE AT 40° C./s | 100 | 0 |
| 18 | K * | 780 | 15 | AFTER 1 s, TO A ROOM TEMPERATURE AT 40° C./s | 100 | 0 |
| 19 | L | 780 | 15 | AFTER 1 s, TO A ROOM TEMPERATURE AT 40° C./s | 100 | 0 |
| 20 | M | 780 | 15 | AFTER 1 s, TO A ROOM TEMPERATURE AT 40° C./s | 100 | 0 |
| 21 | N | 830 | 15 | AFTER 2 s, TO A ROOM TEMPERATURE AT 40° C./s | 100 | 0 |
| 22 | O | 830 | 15 | AFTER 1 s, TO A ROOM TEMPERATURE AT 40° C./s | 100 | 0 |
| 23 | O | 830 | 15 | AFTER 1 s, TO A ROOM TEMPERATURE AT 40° C./s | 100 | 0 |
| 24 | P * | 830 | 15 | AFTER 1 s, TO A ROOM TEMPERATURE AT 40° C./s | 100 | 0 |
| 25 | Q | 830 | 15 | AFTER 1 s, TO A ROOM TEMPERATURE AT 40° C./s | 100 | 0 |
| 26 | R * | 830 | 15 | AFTER 2 s, TO A ROOM TEMPERATURE AT 40° C./s | 100 | 0 |
| 27 | S | 830 | 15 | AFTER 1 s, TO 500° C. AT 40° C./s | 0 | 100 |
| 28 | T | 830 | 15 | AFTER 1 s, TO A ROOM TEMPERATURE AT 40° C./s | 100 | 0 |
| 29 | U * | 830 | 15 | AFTER 1 s, TO A ROOM TEMPERATURE AT 40° C./s | 100 | 0 |
| 30 | V | 830 | 15 | AFTER 2 s, TO A ROOM TEMPERATURE AT 40° C./s | 100 | 0 |
| 31 | V | 830 | 15 | AFTER 1 s, TO A ROOM TEMPERATURE AT 40° C./s | 100 | 0 |
| 32 | V | 830 | 15 | AFTER 1 s, TO A ROOM TEMPERATURE AT 40° C./s | 100 | 0 |
| 33 | W | 830 | 15 | AFTER 1 s, TO A ROOM TEMPERATURE AT 40° C./s | 100 | 0 |
| 34 | W | 860 | 15 | AFTER 2 s, TO A ROOM TEMPERATURE AT 40° C./s | 100 | 0 |
| 35 | X | 830 | 15 | AFTER 1 s, TO A ROOM TEMPERATURE AT 40° C./s | 100 | 0 |
| 36 | Y | 830 | 15 | AFTER 2 s, TO A ROOM TEMPERATURE AT 40° C./s | 100 | 0 |
| 37 | Y | 830 | 15 | AFTER 1 s, TO A ROOM TEMPERATURE AT 40° C./s | 100 | 0 |
| 38 | Z | 830 | 15 | AFTER 1 s, TO A ROOM TEMPERATURE AT 40° C./s | 100 | 0 |
| 39 | Z | 830 | 15 | AFTER 2 s, TO A ROOM TEMPERATURE AT 40° C./s | 100 | 0 |
| 40 | Z | 830 | 15 | AFTER 2 s, TO 620° C. AT 40° C./s | 65 | 0 |
| 41 | AA | 830 | 15 | AFTER 1 s, TO A ROOM TEMPERATURE AT 40° C./s | 100 | 0 |
| 42 | BB | 830 | 15 | AFTER 1 s, TO A ROOM TEMPERATURE AT 25° C./s | 95 | 0 |
| 43 | BB | 830 | 15 | AFTER 1 s, TO A ROOM TEMPERATURE AT 25° C./s | 95 | 0 |
| 44 | BB | 880 | 5 | AFTER 1 s, TO A ROOM TEMPERATURE AT 40° C./s | 100 | 0 |
| 45 | CC | 830 | 15 | AFTER 1 s, TO A ROOM TEMPERATURE AT 40° C./s | 100 | 0 |

TABLE 2-continued

| | | | | | | |
|---|---|---|---|---|---|---|
| 46 | DD | 830 | 15 | AFTER 1 s, TO A ROOM TEMPERATURE AT 40° C./s | 100 | 0 |
| 47 | DD | 830 | 15 | AFTER 1 s, TO A ROOM TEMPERATURE AT 40° C./s | 100 | 0 |

| | STEEL MATERIAL | | | | |
|---|---|---|---|---|---|
| TEST NUMBER | TOTAL VOLUME RATIO (%) | ASPECT RATIO† | ENTIRE V AMOUNT (MASS %) | SOLID-SOLVED V AMOUNT (MASS %) | SOLID-SOLVED V PROPORTION (%) |
| 1 | 100 | 1.8 | — | — | — |
| 2 | 100 | 1.4 | — | — | — |
| 3 | 100 | 1.6 | — | — | — |
| 4 | 95 | 1.2 | — | — | — |
| 5 | 100 | 1.6 | — | — | — |
| 6 | 100 | 1.8 | — | — | — |
| 7 | 100 | 1.6 | — | — | — |
| 8 | 100 | 1.8 | — | — | — |
| 9 | 95 | 1.4 | — | — | — |
| 10 | 100 | 1.9 | — | — | — |
| 11 | 100 | 1.8 | — | — | — |
| 12 | 100 | 1.7 | — | — | — |
| 13 | 100 | 1.6 | — | — | — |
| 14 | 100 | 1.9 | — | — | — |
| 15 | 100 | 1.7 | — | — | — |
| 16 | 100 | 1.6 | — | — | — |
| 17 | 100 | 1.7 | — | — | — |
| 18 | 100 | 1.8 | — | — | — |
| 19 | 100 | 1.8 | — | — | — |
| 20 | 100 | 1.9 | — | — | — |
| 21 | 100 | 1.8 | 0.47 | 0.42 | 89 |
| 22 | 100 | 1.6 | 0.37 | 0.33 | 89 |
| 23 | 100 | 1.6 | 0.37 | 0.32 | 86 |
| 24 | 100 | 1.7 | 0.16 | 0.14 | 88 |
| 25 | 100 | 1.8 | 0.30 | 0.27 | 90 |
| 26 | 100 | 1.7 | 0.16 | 0.13 | 81 |
| 27 | 100 | 1.6 | 0.25 | 0.22 | 88 |
| 28 | 100 | 1.9 | 0.60 | 0.49 | 82 |
| 29 | 100 | 1.6 | 0.10 | 0.08 | 80 |
| 30 | 100 | 1.7 | 0.07 | 0.06 | 86 |
| 31 | 100 | 1.8 | 0.07 | 0.05 | 71 |
| 32 | 100 | 1.6 | 0.07 | 0.06 | 86 |
| 33 | 100 | 1.7 | 0.03 | 0.03 | 100 |
| 34 | 100 | 1.1 | 0.03 | 0.03 | 100 |
| 35 | 100 | 1.6 | 0.30 | 0.25 | 83 |
| 36 | 100 | 1.7 | 0.85 | 0.71 | 84 |
| 37 | 100 | 1.9 | 0.85 | 0.69 | 81 |
| 38 | 100 | 1.7 | 0.20 | 0.17 | 85 |
| 39 | 100 | 1.6 | 0.20 | 0.19 | 95 |
| 40 | 65 | 1.8 | 0.20 | 0.17 | 85 |
| 41 | 100 | 1.6 | 0.10 | 0.09 | 90 |
| 42 | 95 | 1.7 | 0.20 | 0.18 | 90 |
| 43 | 95 | 1.7 | 0.20 | 0.17 | 85 |
| 44 | 100 | 1.3 | 0.20 | 0.17 | 85 |
| 45 | 100 | 1.7 | 0.25 | 0.21 | 84 |
| 46 | 100 | 1.6 | 0.16 | 0.13 | 81 |
| 47 | 100 | 1.8 | 0.16 | 0.14 | 88 |

* MEANING THAT IT IS OUT OF A RANGE OF A CHEMICAL COMPOSITION PRESCRIBED BY THE PRESENT INVENTION.
†MEANING AN ASPECT RATIO OF BAINITE AND MARTENSITE.

TABLE 3

| | | HEATING STEP | HOLDING STEP | | COOLING STEP | |
|---|---|---|---|---|---|---|
| TEST NUMBER | STEEL KIND | AVERAGE HEATING SPEED#1 (° C./s) | HOLDING TEMPERATURE (° C.) | HOLDING TIME#2 (s) | AVERAGE COOLING SPEED#3 (° C./s) | RESIDENCE TIME#4 (s) |
| 1 | A | 3 | 700 | 400 | 50 | 5 |
| 2 | A | 3 | 700 | 300 | 50 | 5 |
| 3 | A | 10 | 700 | 350 | 50 | 5 |
| 4 | A | 3 | 700 | 300 | 50 | 5 |
| 5 | B | 3 | 710 | 350 | 50 | 5 |
| 6 | C | 3 | 720 | 350 | 50 | 5 |
| 7 | D | 3 | 720 | 250 | 50 | 6 |
| 8 | D | 3 | 680 | 200 | 3 | 67 |

TABLE 3-continued

| TEST NUMBER | STEEL KIND | HEATING STEP AVERAGE HEATING SPEED#1 (° C./s) | HOLDING STEP HOLDING TEMPERATURE (° C.) | HOLDING STEP HOLDING TIME#2 (s) | COOLING STEP AVERAGE COOLING SPEED#3 (° C./s) | COOLING STEP RESIDENCE TIME#4 (s) |
|---|---|---|---|---|---|---|
| 9 | D | 3 | 710 | 400 | 50 | 5 |
| 10 | E | 3 | 700 | 400 | 50 | 5 |
| 11 | F * | 3 | 700 | 300 | 50 | 6 |
| 12 | G | 3 | 700 | 350 | 50 | 5 |
| 13 | G | 3 | 800 | 400 | 50 | 5 |
| 14 | H * | 3 | 700 | 200 | 50 | 5 |
| 15 | I | 3 | 700 | 300 | 50 | 5 |
| 16 | J | 3 | 700 | 200 | 50 | 5 |
| 17 | J | 3 | 700 | 2000 | 50 | 5 |
| 18 | K * | 3 | 730 | 250 | 50 | 5 |
| 19 | L | 3 | 700 | 300 | 50 | 5 |
| 20 | M | 3 | 700 | 250 | 50 | 5 |
| 21 | N | 3 | 700 | 400 | 40 | 6 |
| 22 | O | 3 | 710 | 500 | 25 | 10 |
| 23 | O | 0.2 | 680 | 200 | 40 | 5 |
| 24 | P * | 3 | 700 | 500 | 30 | 7 |
| 25 | Q | 3 | 700 | 500 | 40 | 5 |
| 26 | R * | 3 | 690 | 500 | 20 | 11 |
| 27 | S | 3 | 700 | 350 | 10 | 22 |
| 28 | T | 3 | 700 | 700 | 40 | 5 |
| 29 | U * | 3 | 675 | 500 | 30 | 7 |
| 30 | V | 3 | 700 | 500 | 20 | 10 |
| 31 | V | 3 | 675 | 30 | 20 | 10 |
| 32 | V | 3 | 800 | 500 | 20 | 10 |
| 33 | W | 3 | 700 | 500 | 40 | 5 |
| 34 | W | 3 | 700 | 500 | 40 | 5 |
| 35 | X | 3 | 700 | 360 | 8 | 25 |
| 36 | Y | 3 | 700 | 500 | 40 | 5 |
| 37 | Y | 3 | 750 | 300 | 40 | 5 |
| 38 | Z | 3 | 700 | 450 | 40 | 5 |
| 39 | Z | 3 | 690 | 400 | 3 | 67 |
| 40 | Z | 3 | 685 | 500 | 30 | 7 |
| 41 | AA | 3 | 685 | 600 | 30 | 7 |
| 42 | BB | 3 | 705 | 540 | 40 | 5 |
| 43 | BB | 3 | 650 | 500 | 40 | 5 |
| 44 | BB | 3 | 700 | 700 | 40 | 5 |
| 45 | CC | 3 | 700 | 500 | 40 | 5 |
| 46 | DD | 3 | 680 | 500 | 15 | 13 |
| 47 | DD | 3 | 680 | 500 | 10 | 20 |

* MEANING THAT IT IS OUT OF A RANGE PRESCRIBED BY THE PRESENT INVENTION.
#1MEANING AN AVERAGE HEATING SPEED BETWEEN 500° C. AND 670° C.
#2MEANING A TIME TO HOLD A TEMPERATURE AFTER A HOLDING TEMPERATURE IS REACHED.
#3MEANING AN AVERAGE COOLING SPEED BETWEEN THE HOLDING TEMPERATURE AND 150° C.
#4MEANING A RESIDENCE TIME IN A TEMPERATURE RANGE OF 350° C. TO 150° C. DURING COOLING.

The steel material having been used was manufactured by hot-working slab which has been smelted in a laboratory under the condition shown in Table 2. This steel material was cut into a size of 1.6 mm in thickness, 100 mm in width, and 200 mm in length, and was heated, held, and cooled in accordance with the condition of Table 3. A thermocouple was attached to a steel material surface, and temperature measurement during the heat treatment was carried out. An average heating speed shown in Table 3 is a value in a temperature range between 500° C. to 670° C., and a holding time is a time during which a temperature is held, after a holding temperature is reached, at that temperature. Further, an average cooling speed is a value in a temperature range between the holding temperature and 150° C., and a residence time is a residence time in a temperature range from 350° C. to 150° C. during cooling.

Regarding the metal structure of the steel material before the heat treatment, as well as a metal structure and a mechanical property of a steel product obtained by the heat treatment, investigation were carried out by metal structure observation, X-ray diffraction measurement, tensile test, and Charpy impact test as will be described below.

<Metal Structure of Steel Material>

An L cross-section of the steel material was observed and photographed by an electron microscope and a region of 0.04 $mm^2$ in total was analyzed, whereby area ratios and aspect ratios of bainite and martensite were measured. Since the structure of the steel material was isotropic, a value of the above-described area ratio was regarded as a volume ratio of bainite and martensite. Note that the aspect ratio was obtained as a result of dividing a major axis by a minor axis of each grain of bainite and martensite in relation to prior austenite grain, and its average value was calculated.

An observation position was set to be a position of about one fourth a plate thickness (position of ¼t), avoiding a central segregation portion. The reason to avoid the central segregation portion will be described below. The central segregation portion sometimes has a metal structure partially different from a representative metal structure of a steel product. However, the central segregation portion, being a minute region in relation to the entire plate thickness, hardly influences the property of the steel product. In other words, the metal structure of the central segregation portion cannot be referred to as representing the metal structure of the steel product. Thus, in identification of the metal structure, it is preferable to avoid the central segregation portion.

<Solid-solved V Amount in Steel Material>

An amount of V solid-solved in the steel material was measured, after the steel material was subjected to electro-extraction, by analyzing residue by using ICP-OES (Inductively Coupled Plasma Optical Emission Spectrometry).

<Metal Structure of Steel Product>

A test piece of 20 mm in width and 20 mm in length was taken from each steel product, chemical polishing was applied to this test piece to reduce a thickness by 0.4 mm, and X-ray diffraction was performed three times to a surface of the test piece after chemical polishing. Obtained profiles were analyzed and respectively averaged, to thereby calculate a volume ratio of retained austenite.

<Average C Concentration in Retained Austenite>

The profile obtained by X-ray diffraction was analyzed, a lattice constant of austenite was calculated, and an average C concentration in the retained austenite was determined based on the formula below.

$$c=(a-3.572)/0.033$$

Each symbol in the above formula means the following.

a: lattice constant of austenite (A)

c: average C concentration in retained austenite (mass %)

<Thickness of Decarburized Ferrite Layer>

An L cross-section of a steel product was observed and photographed by an electron microscope and a 1 mm region of a steel sheet surface was analyzed, whereby a thickness of a decarburized ferrite layer was measured.

<Number Density of Cementite>

Regarding a number density of cementite, a region of 2500 $\mu m^2$ in total was analyzed to measure the number density of cementite.

<Tensile Test>

A JIS No. 5 tensile test piece of 1.6 mm in thickness was taken from each steel product, a tensile test was carried out based on JIS Z 2241 (2011), and TS (tensile strength), YS (yield strength, 0.2% proof strength), and EL (total elongation) were measured. Further, a value of TS×EL was calculated from the above TS and EL.

<Impact Property>

Front and rear surfaces of each steel product was ground to be 1.2 mm in thickness to thereby fabricate a V notch test piece. Four such test pieces were stacked and screwed and then subjected to a Charpy impact test based on JIS Z 2242 (2005). The impact property was rated as good (○) when an impact value at 0° C. was 30 J/$cm^2$ or more, and was rated as defective (×) when the impact value at 0° C. was less than 30 J/$cm^2$.

Results of the metal structure observation of the steel material are shown in Table 2, and results of X-ray diffraction measurement, tensile tests, and Charpy impact tests are shown together in Table 4.

TABLE 4

| | | RETAINED AUSTENITE | | | | MECHANICAL PROPERTY | |
|---|---|---|---|---|---|---|---|
| | | VOLUME | AVERAGE C | DECARBURIZED | | | |
| TEST NUMBER | STEEL KIND | RATIO (%) | CONCENTRATION (%) | FERRITE LAYER THICKNESS (μm) | CEMENTITE (NUMBER/$\mu m^2$) | YS (MPa) | TS (MPa) |
| 1 | A | 15 | 0.43 | 2.3 | LESS THAN 2 | 795 | 987 |
| 2 | A | 15 | 0.35 | 6.4 * | 2 OR MORE | 802 | 992 |
| 3 | A | 16 | 0.35 | 5.7 * | LESS THAN 2 | 728 | 994 |
| 4 | A | 13 | 0.38 | 7.4 * | 2 OR MORE | 874 | 1003 |
| 5 | B | 18 | 0.28 | 1.2 | LESS THAN 2 | 857 | 994 |
| 6 | C | 13 | 0.43 | 0.4 | LESS THAN 2 | 827 | 1026 |
| 7 | D | 12 | 0.30 | 0.3 | LESS THAN 2 | 795 | 995 |
| 8 | D | 13 | 0.62 | 1.3 | LESS THAN 2 | 753 | 888 * |
| 9 | D | 13 | 0.30 | 5.2 * | 2 OR MORE | 775 | 1002 |
| 10 | E | 20 | 0.28 | 1.1 | LESS THAN 2 | 803 | 1076 |
| 11 | F * | 14 | 0.33 | 1.0 | LESS THAN 2 | 815 | 1103 |
| 12 | G | 20 | 0.35 | 0.5 | LESS THAN 2 | 804 | 1110 |
| 13 | G | 5 * | — # | 0 | LESS THAN 2 | 798 | 1204 |
| 14 | H * | 24 | 0.55 | 0.2 | LESS THAN 2 | 782 | 1319 |
| 15 | I | 18 | 0.37 | 0.4 | LESS THAN 2 | 784 | 1240 |
| 16 | J | 19 | 0.32 | 0.1 | LESS THAN 2 | 806 | 1068 |
| 17 | J | 15 | 0.32 | 6.2 * | LESS THAN 2 | 784 | 1014 |
| 18 | K * | 7 * | — # | 0.2 | LESS THAN 2 | 712 | 823 * |
| 19 | L | 19 | 0.28 | 1.2 | LESS THAN 2 | 786 | 1097 |
| 20 | M | 16 | 0.32 | 0.6 | LESS THAN 2 | 804 | 1005 |
| 21 | N | 16 | 0.28 | 0 | LESS THAN 2 | 998 | 1273 |
| 22 | O | 15 | 0.33 | 0 | LESS THAN 2 | 975 | 1203 |
| 23 | O | 9 * | — # | 0 | LESS THAN 2 | 921 | 1072 |
| 24 | P * | 3 * | — # | 0 | LESS THAN 2 | 647 | 735 * |
| 25 | Q | 15 | 0.33 | 0 | LESS THAN 2 | 967 | 1203 |
| 26 | R * | 2 * | — # | 0 | LESS THAN 2 | 941 | 965 * |
| 27 | S | 18 | 0.35 | 0 | LESS THAN 2 | 997 | 1206 |
| 28 | T | 19 | 0.42 | 0 | LESS THAN 2 | 1052 | 1342 |
| 29 | U * | 7 * | — # | 0 | LESS THAN 2 | 933 | 946 * |
| 30 | V | 24 | 0.33 | 0 | LESS THAN 2 | 920 | 1092 |
| 31 | V | 9 | 0.48 | 0 | LESS THAN 2 | 902 | 975 * |
| 32 | V | 2 * | — # | 0 | LESS THAN 2 | 917 | 1407 |
| 33 | W | 18 | 0.38 | 0.7 | LESS THAN 2 | 910 | 1022 |
| 34 | W | 16 | 0.33 | 5.3 * | 2 OR MORE | 887 | 1004 |
| 35 | X | 15 | 0.45 | 0 | LESS THAN 2 | 965 | 1189 |
| 36 | Y | 18 | 0.35 | 0 | LESS THAN 2 | 1125 | 1408 |
| 37 | Y | 23 | 0.35 | 0 | LESS THAN 2 | 1175 | 1643 |

TABLE 4-continued

| | | | | | | | |
|---|---|---|---|---|---|---|---|
| 38 | Z | 13 | 0.37 | 0 | LESS THAN 2 | 952 | 1105 |
| 39 | Z | 12 | 0.62 | 0 | LESS THAN 2 | 902 | 963 * |
| 40 | Z | 3 * | — # | 0 | LESS THAN 2 | 874 | 924 * |
| 41 | AA | 19 | 0.28 | 0 | LESS THAN 2 | 944 | 1145 |
| 42 | BB | 17 | 0.38 | 0 | LESS THAN 2 | 948 | 1123 |
| 43 | BB | 3 * | — # | 0 | LESS THAN 2 | 941 | 943 * |
| 44 | BB | 15 | 0.35 | 6.2 * | LESS THAN 2 | 939 | 1103 |
| 45 | CC | 20 | 0.37 | 0 | LESS THAN 2 | 961 | 1206 |
| 46 | DD | 23 | 0.46 | 0 | LESS THAN 2 | 943 | 1206 |
| 47 | DD | 26 | 0.44 | 0 | LESS THAN 2 | 938 | 1228 |

| | MECHANICAL PROPERTY | | | |
|---|---|---|---|---|
| TEST NUMBER | EL (%) | TS × EL (MPa · %) | IMPACT PROPERTY | |
| 1 | 24.0 | 23688 | ○ | PRESENT INVENTION EXAMPLE |
| 2 | 24.0 | 23808 | x | COMPARATIVE EXAMPLE |
| 3 | 21.0 | 20874 | x | COMPARATIVE EXAMPLE |
| 4 | 22.0 | 22066 | x | COMPARATIVE EXAMPLE |
| 5 | 23.0 | 22862 | ○ | PRESENT INVENTION EXAMPLE |
| 6 | 22.0 | 22572 | ○ | PRESENT INVENTION EXAMPLE |
| 7 | 24.0 | 23880 | ○ | PRESENT INVENTION EXAMPLE |
| 8 | 31.0 | 27528 | ○ | COMPARATIVE EXAMPLE |
| 9 | 23.0 | 23046 | x | COMPARATIVE EXAMPLE |
| 10 | 24.0 | 25824 | ○ | PRESENT INVENTION EXAMPLE |
| 11 | 23.0 | 25369 | x | COMPARATIVE EXAMPLE |
| 12 | 22.0 | 24420 | ○ | PRESENT INVENTION EXAMPLE |
| 13 | 5.0 | 6020 | ○ | COMPARATIVE EXAMPLE |
| 14 | 20.0 | 26380 | x | COMPARATIVE EXAMPLE |
| 15 | 18.0 | 22320 | ○ | PRESENT INVENTION EXAMPLE |
| 16 | 23.0 | 24564 | ○ | PRESENT INVENTION EXAMPLE |
| 17 | 24.0 | 24336 | x | COMPARATIVE EXAMPLE |
| 18 | 19.0 | 15637 | ○ | COMPARATIVE EXAMPLE |
| 19 | 24.0 | 26328 | ○ | PRESENT INVENTION EXAMPLE |
| 20 | 22.0 | 22110 | ○ | PRESENT INVENTION EXAMPLE |
| 21 | 17.6 | 22405 | ○ | PRESENT INVENTION EXAMPLE |
| 22 | 16.8 | 20210 | ○ | PRESENT INVENTION EXAMPLE |
| 23 | 17.4 | 18653 | x | COMPARATIVE EXAMPLE |
| 24 | 21.5 | 15803 | ○ | COMPARATIVE EXAMPLE |
| 25 | 17.9 | 21534 | ○ | PRESENT INVENTION EXAMPLE |
| 26 | 14.0 | 13510 | ○ | COMPARATIVE EXAMPLE |
| 27 | 18.4 | 22190 | ○ | PRESENT INVENTION EXAMPLE |
| 28 | 18.6 | 24961 | ○ | PRESENT INVENTION EXAMPLE |
| 29 | 16.3 | 15420 | ○ | COMPARATIVE EXAMPLE |
| 30 | 19.5 | 21294 | ○ | PRESENT INVENTION EXAMPLE |
| 31 | 16.3 | 15893 | ○ | COMPARATIVE EXAMPLE |
| 32 | 10.4 | 14633 | ○ | COMPARATIVE EXAMPLE |

TABLE 4-continued

| | | | | |
|---|---|---|---|---|
| 33 | 21.3 | 21769 | ○ | PRESENT INVENTION EXAMPLE |
| 34 | 20.4 | 20482 | x | COMPARATIVE EXAMPLE |
| 35 | 17.9 | 21283 | ○ | PRESENT INVENTION EXAMPLE |
| 36 | 17.3 | 24358 | ○ | PRESENT INVENTION EXAMPLE |
| 37 | 13.8 | 22673 | ○ | PRESENT INVENTION EXAMPLE |
| 38 | 18.4 | 20332 | ○ | PRESENT INVENTION EXAMPLE |
| 39 | 17.0 | 16371 | ○ | COMPARATIVE EXAMPLE |
| 40 | 14.2 | 13121 | ○ | COMPARATIVE EXAMPLE |
| 41 | 17.5 | 20038 | ○ | PRESENT INVENTION EXAMPLE |
| 42 | 19.1 | 21449 | ○ | PRESENT INVENTION EXAMPLE |
| 43 | 15.9 | 14994 | ○ | COMPARATIVE EXAMPLE |
| 44 | 18.8 | 20736 | x | COMPARATIVE EXAMPLE |
| 45 | 18.4 | 22190 | ○ | PRESENT INVENTION EXAMPLE |
| 46 | 19.0 | 22914 | ○ | PRESENT INVENTION EXAMPLE |
| 47 | 23.1 | 28367 | ○ | PRESENT INVENTION EXAMPLE |

* MEANING THAT IT IS OUT OF A RANGE PRESCRIBED BY THE PRESENT INVENTION.
MEANING NOT MEASURED BECAUSE A VOLUME RATIO OF RETAINED AUSTENITE DOES NOT SATISFY A CONDITION.

As shown in Tables 2 to 4, regarding each of comparative examples of test numbers 2, 4, 9, 34, and 44, since the aspect ratios of bainite and martensite of the steel material were less than 1.5, a thickness of the decarburized ferrite layer was over 5 μm, resulting in a bad impact property. Regarding test numbers 8 and 39, a low average cooling speed resulted in excessive generation of pearlite, so that the tensile strength of 980 MPa or more could not be obtained. Regarding a test number 3, a high average heating speed in the heat treatment caused a thickness of the decarburized ferrite layer to be 5 μm or more, resulting in a bad impact property.

Regarding a test number 11, since an Si content was higher than a prescribed range, an impact property was inferior. Regarding a test number 14, since a C content was higher than a prescribed range, an impact property was inferior. Regarding each of test numbers 13 and 32, a high holding temperature in the heat treatment lowered a volume ratio of retained austenite, resulting in bad ductility. Regarding a test number 17, a long holding time in the heat treatment caused a thickness of a decarburized ferrite layer to be 5 μm or more, resulting in a bad impact property.

Regarding each of test numbers 18 and 26, an Mn content was lower than a prescribed range, regarding a test number 24, a C content was lower than a prescribed range, and regarding a test number 29, an Si content was lower than a prescribed range, and thus, ductility was bad and, in addition, tensile strength of 980 MPa or more could not be obtained. Regarding a test number 23, a low heating speed in the heat treatment lowered a volume ratio of retained austenite, resulting in bad ductility and, further, a bad impact property. Regarding a test number 31, since a holding time in the heat treatment was short, a structure to be generated and tensile strength were not stabilized, so that tensile strength of 980 MPa or more could not be obtained. Regarding a test number 40, volume ratios of bainite and martensite were less than 90% in total, and regarding a test number 43, a holding temperature in the heat treatment was low, whereby a volume ratio of retained austenite was low, resulting in that ductility is bad and further that tensile strength of 980 MPa or more could not be obtained.

On the other hand, regarding each of examples of the present invention of test numbers 1, 5 to 7, 10, 12, 15, 16, 19 to 22, 25, 27, 28, 30, 33, 35 to 38, 41, 42, and 45 to 47, tensile strength of 980 MPa or more was obtained, ductility was excellent with a value of a product (TS×EL) of tensile strength and total elongation being 16000 MPa·% or more, and an impact property was also good with an impact value of a Charpy test at 0° C. being 30 J/cm$^2$ or more.

INDUSTRIAL APPLICABILITY

The present invention is usable, for example, in an automobile-related industry, an energy-related industry, and a construction-related industry.

The invention claimed is:

1. A steel product comprising:

a chemical composition represented by, in mass %,

C: 0.050% to 0.35%,

Si: 0.50% to 3.0%,

Mn: exceeding 3.0% to 7.5% or less,

P: 0.05% or less,

S: 0.01% or less, sol. Al: 0.001% to 3.0%,

N: 0.01% or less,

V: 0% to 1.0%,

Ti: 0% to 1.0%,

Nb: 0% to 1.0%,

Cr: 0% to 1.0%,

Mo: 0% to 1.0%,

Cu: 0% to 1.0%,

Ni: 0% to 1.0%,

Ca: 0% to 0.01%,

Mg: 0% to 0.01%,

REM: 0% to 0.01%,

Zr: 0% to 0.01%,
B: 0% to 0.01%,
Bi: 0% to 0.01%, and
the balance: Fe and impurities; and
a metal structure in which a thickness of a decarburized ferrite layer is 5 μm or less and a volume ratio of retained austenite is 10% to 40%,
wherein tensile strength is 980 MPa or more, and
wherein an average C concentration in the retained austenite is 0.6% or less in mass %.

2. The steel product according to claim 1,
wherein, in the metal structure, a number density of cementite is less than $2/\mu m^2$.

3. The steel product according to claim 1,
wherein, in the chemical composition,
V: 0.05% to 1.0%
is satisfied.

4. The steel product according to claim 2,
wherein, in the chemical composition,
V: 0.05% to 1.0%
is satisfied.

5. The steel product according to claim 1,
wherein, in the chemical composition,
Ti: 0.003% to 1.0%,
Nb: 0.003% to 1.0%,
Cr: 0.01% to 1.0%,
Mo: 0.01% to 1.0%,
Cu: 0.01% to 1.0%, or
Ni: 0.01% to 1.0%,
or arbitrary combination of the above is satisfied.

6. The steel product according to claim 2,
wherein, in the chemical composition,
Ti: 0.003% to 1.0%,
Nb: 0.003% to 1.0%,
Cr: 0.01% to 1.0%,
Mo: 0.01% to 1.0%,
Cu: 0.01% to 1.0%, or
Ni: 0.01% to 1.0%,
or arbitrary combination of the above is satisfied.

7. The steel product according to claim 3,
wherein, in the chemical composition,
Ti: 0.003% to 1.0%,
Nb: 0.003% to 1.0%,
Cr: 0.01% to 1.0%,
Mo: 0.01% to 1.0%,
Cu: 0.01% to 1.0%, or
Ni: 0.01% to 1.0%,
or arbitrary combination of the above is satisfied.

8. The steel product according to claim 4,
wherein, in the chemical composition,
Ti: 0.003% to 1.0%,
Nb: 0.003% to 1.0%,
Cr: 0.01% to 1.0%,
Mo: 0.01% to 1.0%,
Cu: 0.01% to 1.0%, or
Ni: 0.01% to 1.0%,
or arbitrary combination of the above is satisfied.

9. The steel product according to claim 1,
wherein, in the chemical composition,
Ca: 0.0003% to 0.01%,
Mg: 0.0003% to 0.01%,
REM: 0.0003% to 0.01%,
Zr: 0.0003% to 0.01%,
B: 0.0003% to 0.01%, or
Bi: 0.0003% to 0.01%,
or arbitrary combination of the above is satisfied.

10. The steel product according to claim 2,
wherein, in the chemical composition,
Ca: 0.0003% to 0.01%,
Mg: 0.0003% to 0.01%,
REM: 0.0003% to 0.01%,
Zr: 0.0003% to 0.01%,
B: 0.0003% to 0.01%, or
Bi: 0.0003% to 0.01%,
or arbitrary combination of the above is satisfied.

11. The steel product according to claim 3,
wherein, in the chemical composition,
Ca: 0.0003% to 0.01%,
Mg: 0.0003% to 0.01%,
REM: 0.0003% to 0.01%,
Zr: 0.0003% to 0.01%,
B: 0.0003% to 0.01%, or
Bi: 0.0003% to 0.01%,
or arbitrary combination of the above is satisfied.

12. The steel product according to claim 4,
wherein, in the chemical composition,
Ca: 0.0003% to 0.01%,
Mg: 0.0003% to 0.01%,
REM: 0.0003% to 0.01%,
Zr: 0.0003% to 0.01%,
B: 0.0003% to 0.01%, or
Bi: 0.0003% to 0.01%,
or arbitrary combination of the above is satisfied.

13. A manufacturing method of the steel product according to claim 1, comprising the steps of:
heating a steel material to a temperature of 670° C. or more in a manner that an average heating speed between 500° C. to 670° C. is 1° C./s to 5° C./s, which steel material has a chemical composition represented by, in mass %,
C: 0.050% to 0.35%,
Si: 0.50% to 3.0%,
Mn: exceeding 3.0% to 7.5% or less,
P: 0.05% or less,
S: 0.01% or less,
sol. Al: 0.001% to 3.0%,
N: 0.01% or less,
V: 0% to 1.0%,
Ti: 0% to 1.0%,
Nb: 0% to 1.0%,
Cr: 0% to 1.0%,
Mo: 0% to 1.0%,
Cu: 0% to 1.0%,
Ni: 0% to 1.0%,
Ca: 0% to 0.01%,
Mg: 0% to 0.01%,
REM: 0% to 0.01%,
Zr: 0% to 0.01%,
B: 0% to 0.01%,
Bi: 0% to 0.01%, and
the balance: Fe and impurities, and has a metal structure in which volume ratios of bainite and martensite are 90% or more in total and an average value of aspect ratios of bainite and martensite is 1.5 or more;
holding the temperature in a temperature range of 670° C. to 780° C. for 60 s to 1200 s after the heating; and
performing cooling to a temperature of 150° C. or less in a manner that an average cooling speed between the temperature range and 150° C. is 5° C./s to 500° C./s, after the holding.

14. The manufacturing method of the steel product according to claim 13, wherein, in the chemical composition, V: 0.05% to 1.0% is satisfied, and wherein 70% or more of V contained in the steel material is solid-solved.

* * * * *